US006705796B2

(12) United States Patent
Lund

(10) Patent No.: US 6,705,796 B2
(45) Date of Patent: Mar. 16, 2004

(54) BARRICADES AND METHODS OF MAKING SAME

(75) Inventor: John Iver Lund, Chicago, IL (US)

(73) Assignee: Cortina Tool & Molding Co., Franklin Park, IL (US)

( * ) Notice: Subject to any disclaimer, the term of this patent is extended or adjusted under 35 U.S.C. 154(b) by 0 days.

(21) Appl. No.: 09/994,338

(22) Filed: Nov. 26, 2001

(65) Prior Publication Data

US 2003/0099511 A1 May 29, 2003

(51) Int. Cl.[7] ..... E01F 9/00; E01F 13/00

(52) U.S. Cl. ..... 404/6; 116/63 P; 40/610; 256/1; 256/64

(58) Field of Search ..... 404/6, 9, 12; 116/63 P, 116/63 R; 40/606.01, 610; 182/153, 183.1, 46, 165; 256/1, 19, 59, 13.1, 64, 66, 65.02, 65.11, 65.12, DIG. 6; 248/558, 166, 170, 436, 163.2; 52/640, 641

(56) References Cited

U.S. PATENT DOCUMENTS

| | | | | | |
|---|---|---|---|---|---|
| 3,015,804 | A | * | 1/1962 | Nunn | 116/63 P |
| 3,089,682 | A | | 5/1963 | Parker | |
| 3,802,667 | A | * | 4/1974 | Kanan | 256/64 |
| 3,880,406 | A | | 4/1975 | Stehle et al. | |
| 3,971,331 | A | | 7/1976 | Sawyer | |
| 4,232,845 | A | * | 11/1980 | Turner | 248/558 X |
| 4,298,186 | A | | 11/1981 | Glass | |
| 4,624,210 | A | | 11/1986 | Glass | |
| 4,674,432 | A | * | 6/1987 | Schmanski | 116/63 P |
| 4,780,020 | A | * | 10/1988 | Terio | 404/6 |
| 4,817,907 | A | * | 4/1989 | Cougan | 248/558 X |
| 4,852,511 | A | * | 8/1989 | Look et al. | 116/63 P |
| 4,859,983 | A | | 8/1989 | Kulp et al. | |
| 4,943,035 | A | | 7/1990 | Thomson et al. | |
| 4,974,815 | A | | 12/1990 | Glass | |
| 5,003,912 | A | | 4/1991 | Thurston | |
| 5,009,541 | A | | 4/1991 | Thurston | |
| 5,046,885 | A | | 9/1991 | Thurston | |
| 5,163,532 | A | * | 11/1992 | McCarty | 182/46 |
| 5,287,946 | A | * | 2/1994 | Mayo | 182/165 |
| 5,458,434 | A | | 10/1995 | Bent et al. | |
| 5,544,614 | A | | 8/1996 | Cushman | |
| 5,570,972 | A | | 11/1996 | Glass et al. | |
| 5,762,444 | A | | 6/1998 | Giannelli | |
| 5,794,923 | A | | 8/1998 | Bartlett | |
| 6,101,967 | A | | 8/2000 | Glass et al. | |
| 6,517,280 | B2 | * | 2/2003 | Carter | 404/6 |

* cited by examiner

*Primary Examiner*—Heather Shackelford
*Assistant Examiner*—Sunil Singh
(74) *Attorney, Agent, or Firm*—Van Metre Lund

(57) ABSTRACT

Versatile multi-function legs can have different end portions to have either a shorter or a longer length but can otherwise be of identical form. In saw-horse structures, the two lengths, together with panels of different heights and connections between legs and panels, allow a variety of configurations. For folding of such structures, sturdy and reliable pivotal connections are provided through engagement of bearing surfaces of knuckle projections on adjacent legs. For A-frame structures, the legs can provide vertical posts that have openings receiving two lower beams and supporting a third beam at a higher elevation. The legs can also provide horizontal sand rails in A-frame structures. Legs of both lengths can be molded using common sets of tools and allowing a change between lengths to be readily made during a press run.

13 Claims, 7 Drawing Sheets

FIG.11
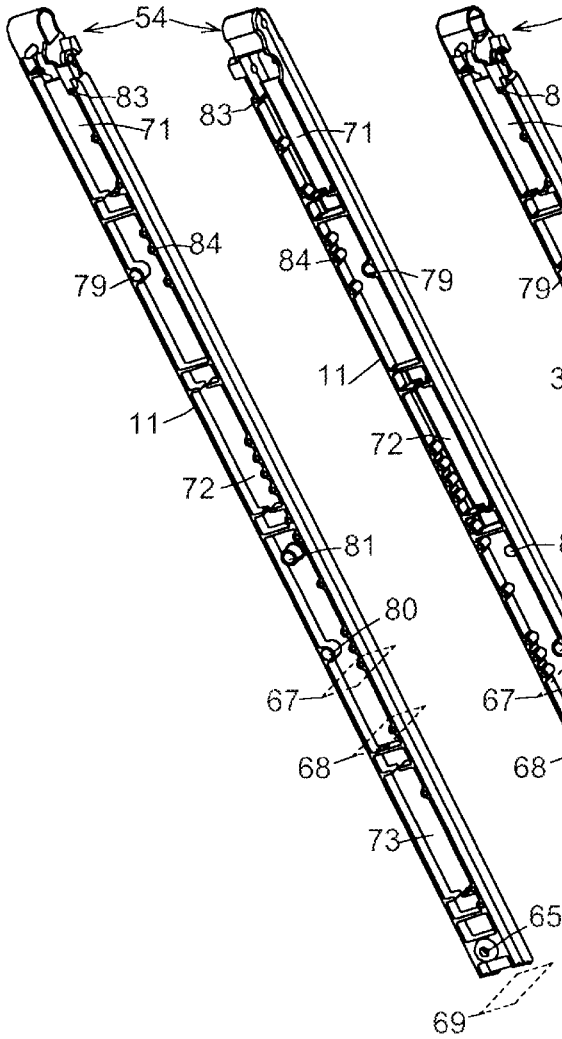
FIG.12
FIG.13
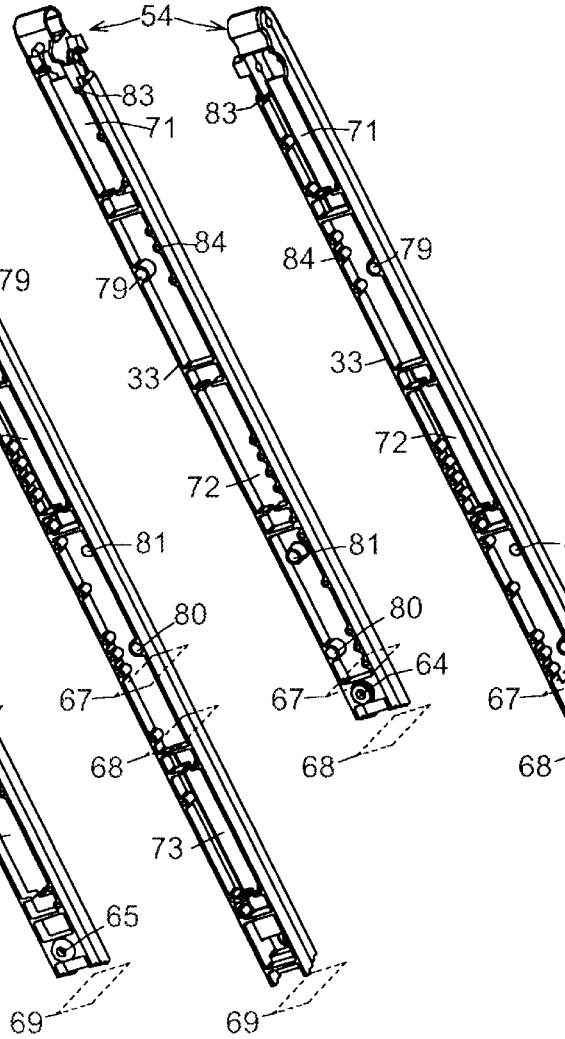
FIG.14

BARRICADES AND METHODS OF MAKING SAME

BACKGROUND OF THE INVENTION

1. Field of the Invention

This invention relates to barricades and more particularly to barricades usable to warn drivers and pedestrians of dangers at construction sites and the like. The barricades of the invention are rugged, reliable and have a long service life. They include component parts that can serve a number of functions and be assembled in a many different ways to provide a variety of configurations including configurations that permit folding for compact storage and transport. Constructions and methods are provided by which the barricades can be economically manufactured and low in cost.

2. Background of the Prior Art

One type of barricade structure is a saw-horse structure in which two units are pivotally connected for movement between a folded condition against each other and an operative condition in inverted V-relation. In an early type of saw-horse structure, many of which are still in current use, each unit is in the form of a subassembly with wood panels secured to a pair of metal legs with bolts connecting the legs to form the pivotal connection.

Many saw-horse structures have been used or proposed using components molded from plastic. The Stehle et al. U.S. Pat. No. 3,880,406 issued Apr. 29, 1975 discloses a plastic barricade in which units are pivotally connected by bolts after being formed with integral panels and legs. The units are formed by rotational casting to be hollow and to be filled with sand or other ballast to resist tipping over.

The Sawyer U.S. Pat. No. 3,971,331 issued Jul. 27, 1976 discloses use of panels formed by plastic and secured to legs that are connected by bolts.

The Glass U.S. Pat. No. 4,298,186 issued Nov. 3, 1981 discloses a barricade including a pair of identical members of hollow plastic that provide integral panels and legs. The members have hinge sections located at upper corners thereof and configured to be connected together by bolts. At the lower ends, hollow sand bars are provided for receiving sand bags.

The Glass U.S. Pat. No. 4,624,210 issued Nov. 25, 1986 discloses a barricade similar to that of U.S. Pat. No. 4,298,186 but having a special detent for locking the structure in an operative condition.

The Kulp U.S. Pat. No. 4,859,983 issued Aug. 22, 1989 discloses a barricade which is similar to the saw-horse structures of the Glass and other prior patents in having a pair of members of plastic that have hinge portions connected by hinge pins and that provide integral panels and legs. The barricade is described as being of the A-frame type but is unlike the A-frame structures described herein which include beams or rails supported between two A-shaped members.

The Glass U.S. Pat. No. 4,974,815 issued Dec. 4, 1990 discloses a barricade including a pair of members of plastic that provide integral panels and legs. The members are connected by a hinge pin which extends through a handle member.

The Thurston U.S. Pat. No. 5,003,912 issued Apr. 2, 1991 discloses a plastic barricade which includes two identical integrally molded plastic panels connected by hinge pins. Each panel has protrusions and indentations which can interlock with those of adjacent panels when stacking the panels.

The Thurston U.S. Pat. No. 5,009,541 issued Apr. 23, 1991 discloses plastic barricade having hinges formed by a cylindrical male boss that can mate with on open C-type clamp of sufficient flexibility as to form a female socket that can be snapped onto the male boss. As described, different cross-sections may be used and all that is necessary is that no unwanted forces are applied to the relatively fragile plastic hinge.

The Thurston U.S. Pat. No. 5,046,885 issued Sep. 10, 1991 discloses a hinged barricade similar to that of his U.S. Pat. No. 5,009,541 but differing in that the C-shaped female socket is formed by compression molding an in that the male boss has diametrically opposed flattened sides for insertion into the socket. After insertion into the socket, a limiting bolt is installed to limit the relative angular displacement to 40 degrees.

The Bent et al. U.S. Pat. No. 5,458,434 issued Oct. 17, 1995 discloses a plastic barricade formed from identical panels and hinged together by bolts The panels include handles at the top and a bottom-most cross-member formed with a stacking lug that can fit into an opening of a handle of an adjacent folded barricade.

The Cushman U.S. Pat. No. 5,544,614 issued Aug. 13, 1996 discloses a barricade assembly including a plurality of panel units which can be secured together, one above another, to provide an adjustable height. The uppermost panels are connected by hinge bolts or pins.

The Glass et al. U.S. Pat. No. 5,570,972 issued Nov. 5, 1996 discloses a plastic traffic barricade formed by two panel units connected by hinge bolts, each panel having an integral handle arranged for mounting of a flasher light thereon.

The Glass et al. U.S. Pat. No. 6,101,967 issued Aug. 15, 2000 discloses a barricade formed by two units each including a pair of legs and a plurality of panels formed by blow-molding. The upper ends of the legs of each unit are connected by hinge bolts to the upper ends of the legs of the other unit. Each leg has an I-beamed shaped cross-section recesses with depressions in one flange thereof. Channels are formed in an inner face of each panel adjacent the opposite ends thereof to receive leg members while being seated in the depressions of the leg members.

The foregoing patents related to saw-horse structures. Another barricade structure, referred to herein as an A-frame structure, includes rails or beams which have ends supported by members which are A-shaped. The Parker U.S. Pat. No. 3,089,682 issued May 14, 1963 discloses a barricade including a one-piece top member which forms a rail or beam and which is supported by a pair of oppositely disposed A-shaped legs. The top member and legs are disclosed as being formed of resilient hard rubber.

The Thomson et al. U.S. Pat. No. 4,943,035 issued Jul. 24, 1990 discloses a barricade with A-shaped members supporting the ends of an elongated hollow crossbar which includes elongated hollow inter-connecting sections.

The Giannelli U.S. Pat. No. 5,762,444 issued Jun. 9, 1998 discloses an A-frame barricade capable of being adjusted to a desired length. A pair of A-frames are connected by a transverse beam assembly which includes a pair of members arranged for relative slidable movement to be of adjustable length. Each A-frame includes an opening for receiving an end of the beam assembly and also includes a cross brace portion with an integral bracket providing a second opening which can receive the end of an auxiliary cross-beam. The auxiliary cross-beam is not shown but can be used to support one of more sand bags.

The Bartlett U.S. Pat. No. 5,794,923 issued Aug. 18, 1998 discloses a dressage arena fence with brackets that are A-shaped with a pair of leg portions that extend downwardly and outwardly from an apex portion but with no cross brace. Slots are provided in the brackets for interlocking engagement with ends of rails. As shown, one slot is provided in one leg of a bracket while two slots are provided in the opposite leg of the bracket.

SUMMARY OF THE INVENTION

This invention was evolved with the general object of making barricades that will better serve the requirements of users, that will be rugged and reliable and have a long life and that can be economically manufactured.

Important aspects of the invention relate to the recognition of problems with prior art barricades and analyses of how to deal with those problem. One problem is that although the barricade configurations known in the art are suitable for many applications, there are many applications where different configurations would be desirable. One way to deal with this problem might be to simply modify known configurations to produce a number of configurations each suitable for a particular application. However, it is desirable that barricades be of plastic and providing the tooling required to produce a number of configurations could be prohibitively expensive.

One particular problem with prior saw-horse barricades of molded plastic is that each has a particular size and panel configuration which will not be ideal for many applications. Another particular problem with prior saw-horse barricades is that although their typical height of around forty inches is suitable for many applications, there are other applications in which a greater height would be desirable. For example, barricades are frequently used to warn drivers or pedestrians about excavations that may be one to two feet in depth. If a structure with a height of forty inches is placed in such an excavation, the upper end may not be sufficiently visible, and if placed outside such an excavation, the structure can be displaced to fall into the excavation. These problems might be avoided by providing higher structures that can be placed in a stable position in an excavation and have an upper end that is in a clearly visible position.

A-frame barricade structures have a similar height problem. Both types of structures have potential stability problem in that increasing the height without other changes will increase the likelihood that wind or other forces will overturn the barricade.

In accordance with important features of this invention, legs are provided that have the same configurations but can perform a variety of functions in both saw-horse and A-frame structures.

To provide saw-horse structures, a pair of the legs are connected by panels to form each of two subassemblies which are pivotally connected. The panels are of different heights and holes are provided in the panels and legs to allow for connection in different configurations, each suitable for a particular application.

The legs can also be used to increase height and stability of A-frame structures in which a pair of A-frames are provided each having two vertically spaced openings through which two beams extend to be supported by said A-frames. To increase height, each leg can provide three openings along its length and each is arranged to extend vertically along an A-frame with the lower two of the three openings of the leg in registry with two openings in the A-frame to receive and be supported by the two beams. With two legs so supported from two A-frames, the third of the three openings of the legs can receive and support the ends of a third beam at a higher elevation.

To increase stability of an A-frame structure, a pair of the legs can be connected to lower ends of the legs of the A-frames with each extending horizontally beyond the such lower ends of the legs and increase an effective horizontal base dimension of the structure. A pair of legs can be so used in a complementary fashion to compensate for a decrease in stability which might otherwise result from use of a pair of legs to increase height. However, one pair of legs can be used to increase stability of an A-frame structure without using a pair of the legs to increase height.

Important features relate to the provision of legs that can be of either a shorter size or a longer size to be usable to provide two different heights in saw-horse structures with the longer size being usable in A-frame structures to increase height and to increase stability. The legs are so configured that both sizes can be molded with similar configurations but with minimal tooling changes. The legs of either size are identical, facilitating low tooling costs and low manufacturing costs.

In accordance with specific features of the invention, each leg includes two spaced longitudinally extending flanges and a web extending between and connecting the flanges. Frangible portions are preferably provided in the web which can be hammered out to produce the opening desired for extending the height of A-frame structures but which can be left in place for strength and rigidity when used in saw-horse structures or for stability of A-frame structures. A series of holes is provided in one flange for mounting of a panel in engagement with edges of both flanges when used in a saw-horse type structure.

A very important feature of the invention relates to the provision of projecting portions on the one end of each leg which can engage like portions on an adjacent leg to provide a knuckle journaling the legs for relative movement about a pivot axis between a closed condition in side-by-side relation and an open condition in inverted-V relation. With this feature, the legs can be identical but a strong and highly reliable pivot connection can be provided without using any bolts or pivot pins.

In a preferred construction, projecting portions of each leg define a pair of internal bearing surfaces facing each other and a pivot axis and define a pair of external bearing surfaces facing in opposite directions away from said axis, the internal bearing surfaces of each leg being engageable with the external bearing surfaces. The relative diameters and axial lengths of said external and internal bearing surfaces are such as to develop high frictional forces opposing relative axial movement of subassemblies of which the legs form a part. A positive limit on such axial movement is provided by engagement of legs with upper portions of connecting panels which are deformable to facilitate assembly and disassembly but which are not likely to deform during use even under the normally rough handling expected at a construction site.

Another feature is that the projecting portions of each leg define stop surfaces that are engageable with said stop surfaces of the other leg to limit the relative pivotal movement. In addition, the legs are provided with hook portions which function to engage upper portions of panels to assist in limiting relative pivotal movement the subassemblies.

A further feature is that folded assemblies are flat and compact and can be can be stacked with other like assemblies for storage and transport. Each of the legs includes a projecting post at one end and a hole at the opposite end, each post being arranged to engage in a socket provided by a hole of a leg of another assembly for alignment when stacked. The same hole is usable for mounting of a warning light when the leg is used as a vertical post in an A-frame structure.

Still another feature relates to the construction of panels which are arranged to be mounted in predetermined positions on the legs and which include portions which mate with the legs to insure mounting in such predetermined positions during assembly.

Further important features relate to methods molding of the legs. Shorter legs are molded using a first set of tools for forming major portions of the lengths of the shorter legs and using a second set of tools of short length for forming only lower end portions of the shorter legs, Longer legs are molded the first set of tools for forming substantial portions of the lengths of the longer legs together with a third set of tools for forming intermediate portions of the longer legs and a fourth set of tools for forming lower leg portions of longer legs. The third set of tools have the same short length as said second set of tools to be interchangeable therewith. During a press run, the first and fourth sets of tools can be kept in place in a press at all times, changing between molding of short and long legs during the press run being effected by interchanging said second and third sets of tools.

To provide for use of longer legs as vertical posts of A-frame structures, a web portion of each leg is so molded through use of first set of tools as to produce two frangible web portions and is so molded through use of the fourth set of tools as to produce a third frangible web portion, such frangible web portions being so formed that they can be hammered out and removed to provide three beam openings along the length of longer legs. Such frangible web portions are also so formed as to provide added strength when left in place in either shorter or longer legs that are used in saw-horse type structures.

The invention thus provides legs and panels which can perform a wide variety of functions with a high degree of reliability but which can be molded from plastic with minimal tooling and at low costs.

This invention contemplates other objects, features and advantages which will become more fully apparent from the following detailed description taken in conjunction with the accompanying drawings.

BRIEF DESCRIPTION OF THE DRAWING FIGURES

FIG. 11 is a perspective view showing two sides of a longer leg;

FIG. 12 is a perspective view of the other two sides of the longer leg shown in FIG. 11

FIGS. 13 and 14 are views like FIGS. 11 and 12, but showing a shorter leg;

DESCRIPTION OF PREFERRED EMBODIMENTS

In accordance with the invention, legs and panels are molded from plastic and can be economically manufactured. They have a limited number of forms but can be assembled in many different ways to provide barricade structures usable for a wide variety of purposes. The structures include saw-horse structures, examples of which are provided in FIGS. 1–5, and include A-frame structures, one example of which is provided in FIG. 6.

Figure 1:
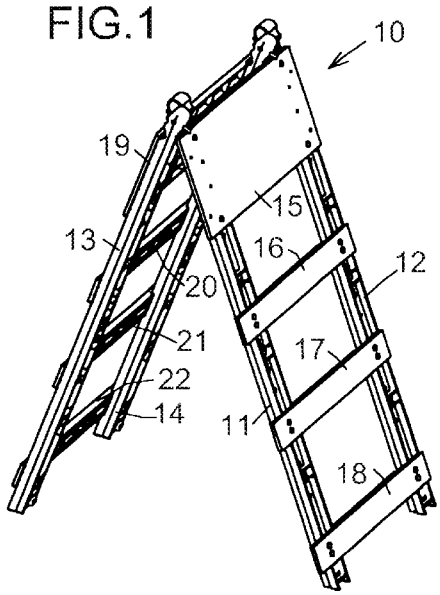
FIG. 1 is a perspective view showing a saw-horse structure of the invention formed by an assembly of panels on longer legs to provide one configuration.

Each saw-horse structure comprises two pairs of legs of either a shorter length, e.g. 44 inches, or a longer length, e.g. 60 inches, with each pair of legs connected by at least one panel to provide two subassemblies. The subassemblies are pivotally connected to be movable between an operative condition in inverted-V relation and a flat, folded condition for stacking, storage and transport. In FIG. 1, a saw-horse structure 10 is shown in an operative condition. Structure 10 includes a pair of longer legs 11 and 12, a second pair of longer legs 13 and 14, panels 15, 16, 17 and 18 connecting the legs 11 and 12 and panels 19, 20, 21 and 22 connecting the legs 13 and 14. As shown, the upper panels 15 and 19 are relatively tall while the panels 16–18 and 20–22 are short. In a typical use along a construction site, the upper panels 15 and 19 may have angular strips of orange reflective material secured thereto for warning purposes. The lower panels 16–18 and 20–22 provide strength and rigidity. The lowermost panels 18 and 22 are usable to receive sand bags or the like to more securely hold the structure 10 in place.

Figure 2:
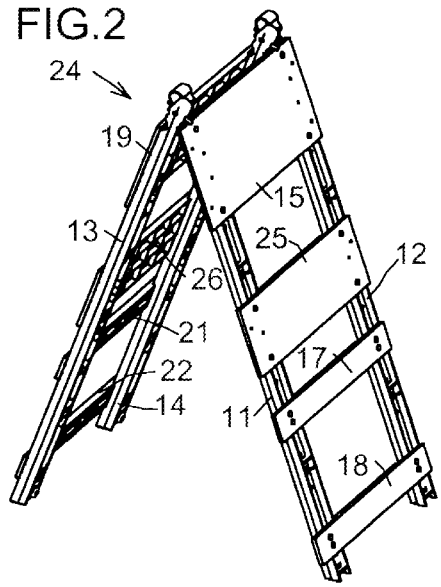
FIG. 2 is a perspective view showing a saw-horse structure that is similar to that of FIG. 1 but that has a different arrangement of panels.

FIG. 2 shows a structure 24 that is identical to the structure 10 except that the short panels 16 and 20 of structure 10 are replaced by panels 25 and 26 of intermediate height, less than that of taller panels 15 and 19 and greater than that of the short panels 16–18 and 20–22. The panels 25 and 26 may have warning strips or indicia applied thereto, or may be used for any other desired purpose.

Figure 3:
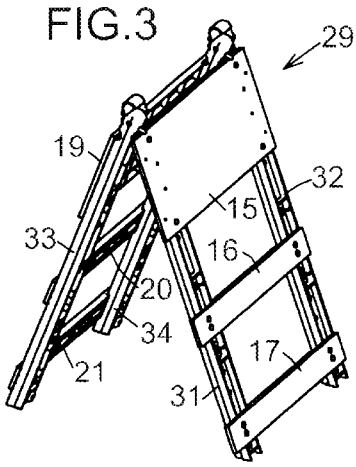
FIG. 3 is a perspective view showing saw-horse structure that is similar to that of FIG. 1 but that uses shorter legs and a fewer number of panels.
Figure 4:
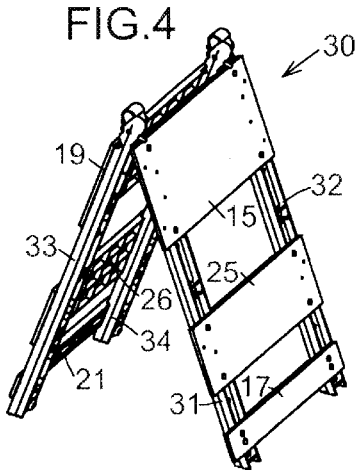
FIG. 4 is a perspective view showing a saw-horse structure that is similar to that of FIG. 2 but that uses using shorter legs and a fewer number of panels.

FIGS. 3 and 4 show structures 29 and 30 that are like the structures 10 and 24, except in having shorter legs 31, 32, 33 and 34 and except that the lowermost panels 18 and 22 of structures 10 and 24 are not used.

Figure 5:
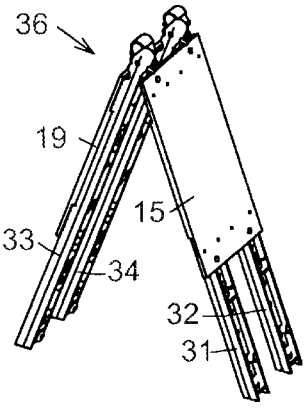
FIG. 5 is a perspective view showing a saw-horse structure that is similar to FIG. 3 in using shorter legs but with fewer panels and having a narrow configuration.

FIG. 5 shows still another saw-horse structure 36 in which the panel 15 is turned 90 degrees and secured to legs 31 and 32 while panel 19 is turned 90 degrees and secured to legs 33 and 34. The result is a narrow structure that is very useful in special circumstances.

The panels are secured to the legs by fastening elements which may be rivets although bolts or other equivalent elements may be used. Holes are provided in the panels and legs for receiving the fastener elements and for permitting use of all of the configurations shown in FIGS. 1–5 and many others as well. With legs of two different lengths and panels of three different heights as shown, there are many possible configurations of the saw-horse barricades.

Structures with shorter legs, such as shown in FIGS. 3–5, are satisfactory for many applications. However, structures with longer legs, such as shown in FIGS. 1 and 2, are oftentimes advantageous and it is highly desirable that they be available. For example, barricades are frequently used to warn drivers or pedestrians about excavations that may be one to two feet in depth. If a structure with shorter legs is placed in such an excavation, the upper panel may not be sufficiently visible, and if placed outside such an excavation, the structure can be displaced to fall into the excavation. These problems are avoided by using structures such as structures 10 and 24 with longer legs that can be placed in an excavation and still have the uppermost panel in a clearly visible position.

Figure 6:
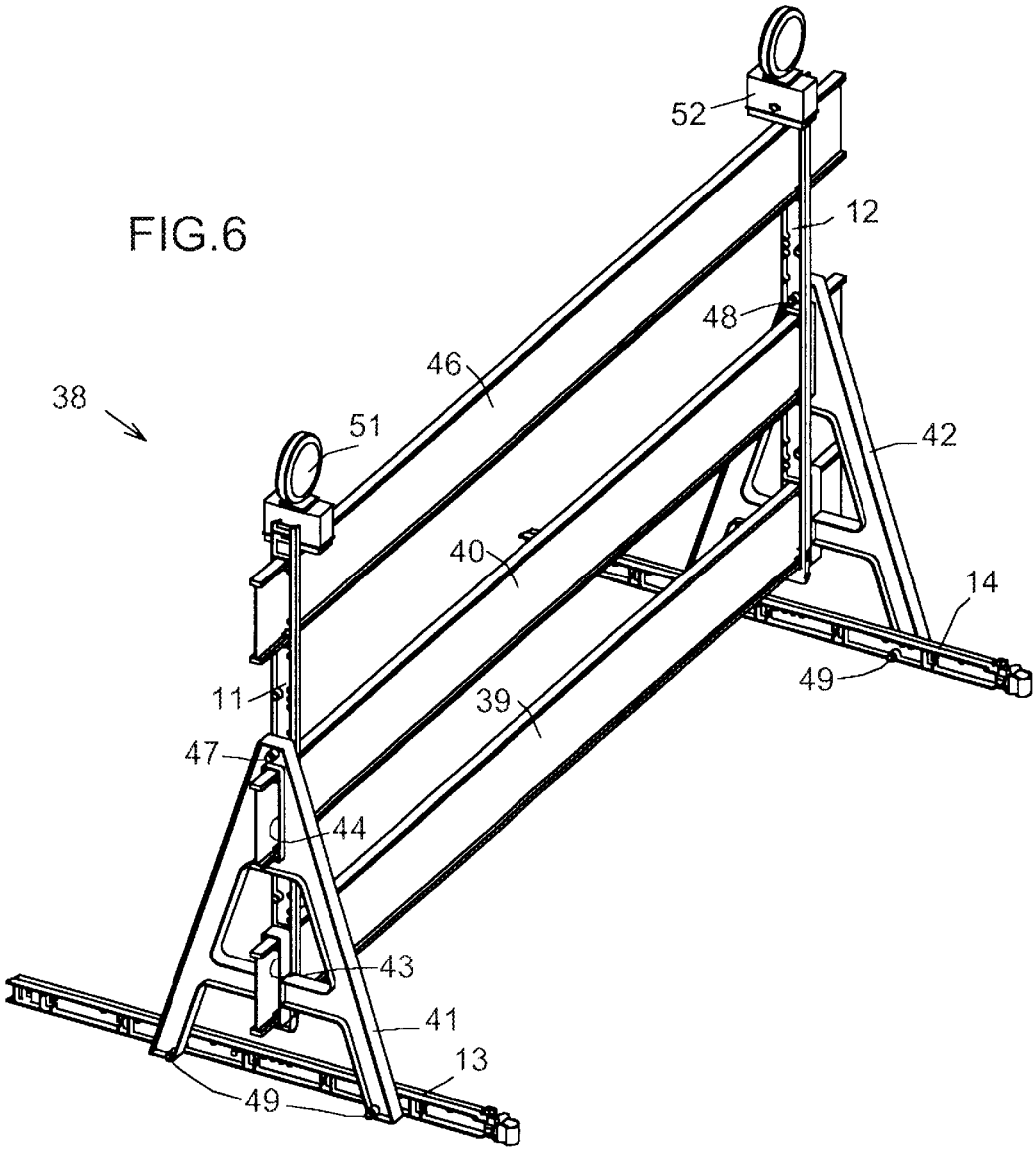
FIG. 6 is a perspective view showing an A-frame structure in which the same legs as used in the saw-horse structures of FIGS. 1 and 2 are used for stabilization and to obtain an extended height.

FIG. 6 shows an A-frame structure 38 that uses the same legs 11, 12, 13 and 14 as used in the saw-horse structures 10 and 24 but for different purposes. The A-frame structure 38 includes beams 39 and 40 supported in vertically spaced relation that are supported by two A-frames 41 and 42 which are similar to the A-frames disclosed in the Giannelli U.S. Pat. No. 5,762,444. Openings 43 and 44 are provided in the frame 41 for receiving and supporting the beams 39 and 40, similar openings, not visible in FIG. 6, being provided in the frame 42.

Legs 11 and 12 are used to support a third beam 46 at a position substantially higher than that of the higher A-frame supported beam 40. For this purpose, each of the legs 11 and 12 is arranged to provide three vertically spaced openings, a highest opening through which the beam 46 extends and two lower openings that register with the A-frame openings 43 and 44 and through which the beams 39 and 40 extend. The beam 46 is thereby supported from the legs 11 and 12 which are supported from the beams 39 and 40, beams 39 and 40 being supported by the A-frames 41 and 42. In addition, bolts 47 and 48 extend through openings at the apexes of the A-frames 41 and 42 and through openings in the legs 11 and 12 to provide direct support of the legs 11 and 12 from the A-frames 41 and 42 and to prevent horizontal movement of the legs 11 and 12 relative to the A-frames 41 and 42.

Legs 13 and 14 are used to stabilize the A-frame structure 38 by being secured in horizontal positions to the lower ends of legs of the A-frames 41 and 42. Bolts 49 extend through holes in the legs 13 and 14 and through bolt holes in the legs of the A-frames 41 and 42. End portions of the legs 13 and 14 extend outwardly beyond the lower ends of the legs of A-frames 41 and 42 to stabilize the structure and may receive sand bags or the like for additional stabilization. The legs 13 and 14 when used as shown in FIG. 6 thereby function as "sand rails".

The upper beam 46 as well as the lower beams 39 and 40 may have warning strips of reflective material or other indicia applied thereto. In addition, each of the legs 11 and 12 is provided with a hole at one end for mounting of a warning light, two warning lights 51 and 52 being shown secured to the upper ends of the legs 11 and 12 in FIG. 6.

In FIG. 6, the relative orientation of the legs 11 and 12 is reversed from that shown in FIGS. 1 and 2. The ends of the legs 11 and 12 which support the lights 51 and 52 and which are uppermost in FIG. 6 are the ends that engage a supporting surface and that are lowermost when used in a saw-horse structure as in FIGS. 1 and 2. This reversal of orientation allows use of the legs for both saw-horse and A-frame structures while also so positioning the leg openings as to obtain an upward distance from beam 40 to beam 46 that is substantially greater than the upward distance from the beam 39 to the beam 40, thereby placing the beam 46 at a high and readily visible position. Such positioning of the leg openings, in turn, facilitates forming of both longer and shorter legs using common molding tools, as hereinafter described.

Figure 7:
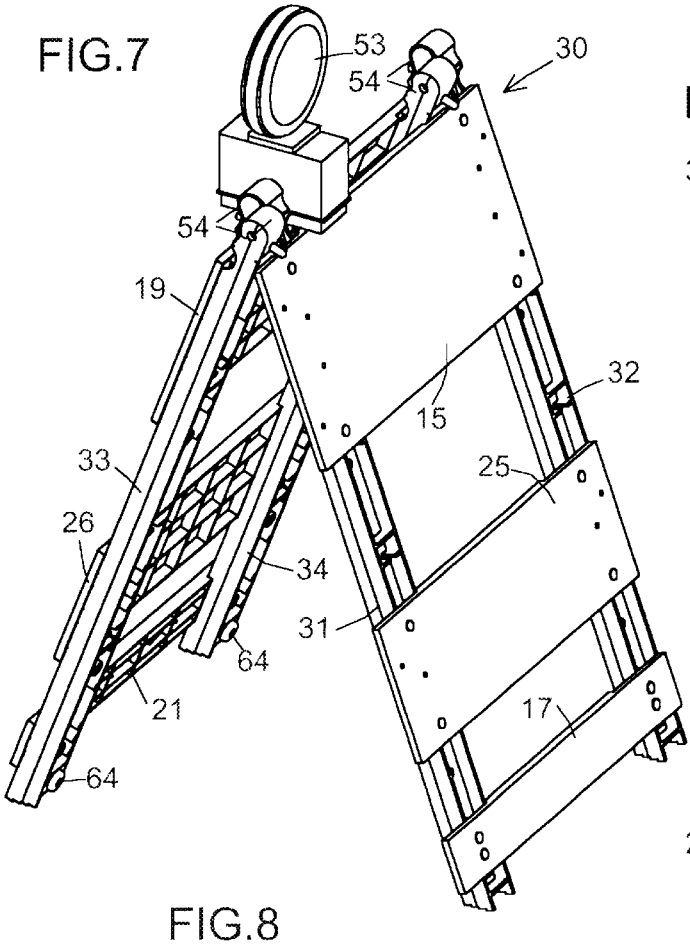
FIG. 7 is a perspective view showing the saw-horse structure of FIG. 4 on an enlarged scale, also showing the mounting of a warning light thereon.
Figure 8:
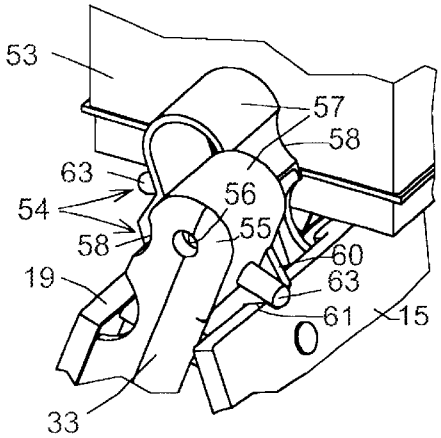
FIG. 8 is an enlargement of a portion of FIG. 7, showing features of construction of end portions of legs for mounting of lights and for limiting relative pivoting of subassemblies of the saw-horse structure.

FIG. 7 shows the saw-horse structure 30 of FIG. 4 on an enlarged scale and also shows a warning light 53 secured to an end structure 54 that is provided on the leg 31 as well as on the corresponding end of all other legs, both shorter and longer. FIG. 8 is an enlargement of a portion of FIG. 7, more clearly showing the form of portions of the end structures 54 that are usable for mounting of lights, also showing portions used for limiting pivotal movement of subassemblies and portions usable in aligning folded and stacked saw-horse structures. Other portions of the end structure 54 are used for providing knuckles that journal two legs for pivotal movement. The knuckle portions are not shown in FIG. 8 but are shown in FIGS. 11–16, especially in FIGS. 15 and 16 which are enlargements of portions of FIGS. 11 and 13 and FIGS. 12 and 14.

As shown in FIG. 8, each structure 54 includes a wall 55 having a bolt hole 56 for mounting of a warning light. The wall 55 is at the end of a wall 57 which is of generally tubular form to provide a guide for receiving a wrench socket during mounting of a lamp and to also provide additional strength. A recess 58 is formed in each structure 54 to provide clearance when mounting a light on an adjacent structure and when the saw-horse structure is in an open operative condition as shown.

A hook portion 60 is provided on each end structure 54 which includes a surface 61 engageable with the upper edge of a panel to limit pivotal movement of subassemblies. The surface 61 shown in FIG. 8 is part of the end structure 54 on the end of the leg 33 which is part of one subassembly and is shown engaged with the upper edge of the panel 15 which is secured to the leg 31 and part of the other subassembly of the illustrated saw-horse structure.

Figure 9:
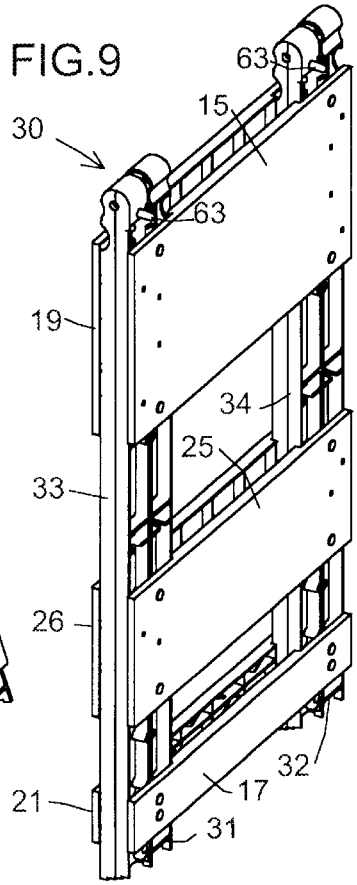
FIG. 9 is a perspective view showing the saw-horse structure of FIG. 4 on an enlarged scale and in a compact folded condition.
Figure 10:
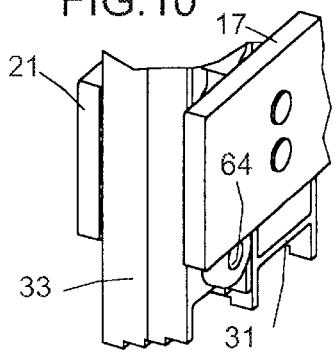
FIG. 10 is an enlargement of a portion of FIG. 9, showing a socket used in aligning structures when folded and stacked.

A post 63 is provided on each end structure 54 for use in facilitating stacking of saw-horse structures when in a closed or folded condition as shown in FIG. 9. When one folded saw-horse structure is turned 180 degrees relative to an adjacent folded structure, the end of the post 63 can engage in a socket that is provided by a hole 64 in an end structure of each leg that is opposite the end structure 54. FIG. 10, which is an enlargement of a lower portion of FIG. 9, more clearly shows the hole 64 provided in the lower end of leg 33.

FIG. 11 shows two sides of the longer leg while FIG. 12 show the other two sides of the longer leg 11. FIGS. 13 and 14 are like FIGS. 11 and 12 but show the shorter leg 33. In FIGS. 11 and 12, hole 65 is shown in the longer leg 11 which is like the hole 64 of the shorter leg and which is in an end structure of the leg opposite the end structure 54. When saw-horse structures that use longer legs are folded and stacked, the hole 65 acts as a socket to receive a post 63 of a leg of an adjacent structure. When a longer leg is used in an A-frame structure with its orientation reversed, the hole 65 is at the upper end of the leg and is usable as a bolt hole for mounting of a warning light such as light 51 shown in FIG. 6.

An important feature of the invention relates to the pivotal connection of legs through projecting knuckle portions on the end portions 54 of both the longer and shorter legs. This feature is more clearly shown in FIGS. 15 and 16 as discussed hereinafter.

FIGS. 11–14 illustrate another important feature which relates to a method of injection molding of the legs, especially with respect to use of common tools in molding of both longer and shorter legs. In forming both longer and shorter legs, mating tools are brought together to define walls of a cavity into which plastic is injected to form each leg, the tools being thereafter separated for removal of the formed leg. In forming shorter legs such as leg 33 shown in FIGS. 13 and 14, first and second sets of tools are used. The first set is used for forming the end structure 54 and for forming a major portion of each leg, extending up to a plane 67 which is indicated by broken lines in FIGS. 13 and 14 as well as FIGS. 11 and 12. The second set of tools extends for a short distance from plane 67 to a plane 68 and is used for forming an end structure 67 which extends from the plane 6667 to the end of the leg.

In forming longer legs such as leg 11 as shown in FIGS. 11 and 12, the first set of tools is used together with third and fourth sets of tools. The first set is used for forming the end structure 54 and a substantial portion of the longer leg, extending up to the plane 67. The third set is used for forming a short portion of the longer leg extending from the plane 67 to the plane 68. The fourth set extends from plane 68 to plane 69 and is used for forming a portion of the longer leg that extends from plane 68 to the end of the leg. With this method, the only tooling change that is required for changing between molding of shorter and longer legs is to interchange the second and third tools each of which has the same short length and is of relatively small size and weight. This change can be done quickly in a molding press during a press run without removing the first and fourth sets of tools from the press.

A further feature shown in FIGS. 11–14 is a construction of the legs that facilitates provision of beam openings for use of longer legs as vertical A-frame members while providing high strength in all other uses of longer and shorter legs. During molding of both shorter and longer legs, frangible portions 71 and 72 are produced by the aforementioned first set of tools. During molding of a longer leg, a third frangible portion 73 is produced by the aforementioned fourth set of tools. The frangible portions 71–73 are left in place and provide substantial additional strength against bending when legs of either length are used in saw-horse structures and when longer legs are used as horizontal stabilizing members in A-frame structures. However, when the longer leg is to be used as a vertical member of an A-frame structure, the frangible portions 71, 72 and 73 are hammered out and removed to provide three openings that receive the beams 39, 40 and 46.

The frangible portions 71, 72 and 73 are parts of web portions of the legs, each leg having an I-beam configuration with a web portion joining two spaced parallel flange portions. During molding, one tool of a set defines one wall of the web portion and walls of a portion of each flange portion while a mating tool of the set defines the opposite wall of the web portion and walls of the remaining portion of each flange portion. After tools are separated for removal of a leg, visible separation lines may be produced on the flange portions as indicated by lines 75 and 76 in FIGS. 11 and 12 and lines 77 and 78 in FIGS. 13 and 14.

The mating tools also produce through holes in the legs including the hole 64 in a shorter leg, the hole 65 in a longer leg and holes 79, 80 and 81 in both shorter and longer legs. Holes 79 and 80 are used when using bolts 49 to secure longer legs such as legs 13 and 14 to lower ends of the legs of an A-frame member as shown in FIG. 6. Hole 81 is used when using bolts 47 and 48 to secure longer legs such as legs 11 and 12 to apex points of A-frame members as also shown in FIG. 6. The mating tools also produce a series of through holes in one flange portion of each leg for registering with holes in panels and securing panels in proper positions on the legs. For example, holes 83 and 84 are produced for use in mounting the panels 15 and 19 on either longer or shorter legs when used in saw-horse structures.

As aforementioned, an important feature of the invention is the provision of knuckle portions on the end portions 54 of both the longer and shorter legs for pivotal connection of pairs of legs used in forming subassemblies of saw-horse structures. The knuckle portions are shown in FIGS. 11–14 but are more clearly shown in FIGS. 15 and 16 which are enlargements of portions of FIGS. 11 and 12 and which may be considered to be enlargement of portions of FIGS. 13 and 14, the end portions 54 being of identical form in both longer and shorter legs. Each end portion 54 includes a planar surface 87 that is in transverse relation to a pivot axis indicated by broken line 88. Knuckle portions 89 and 90 project from the surface 87 to end surfaces that are in a plane parallel to the surface 87 and they provide a pair of internal bearing surfaces 91 and 92 that face each other and the pivot axis 88. Another knuckle portion 94 also projects from the surface 87 and to an intermediate plane which is approximately midway between the plane of the surface 87 and the plane of end surfaces of the portions 89 and 90. The portion provides a pair of external bearing surfaces 95 and 96. When two legs are brought together in side-by-side relation and with the end surface of portions 89 and 90 in engagement with surfaces, the internal bearing surfaces 91 and 92 of one leg engage the external bearing surfaces 95 and 96 of the other leg to provide a pivotal connection between the legs.

The projecting portions 89 and 90 extend between two planes through the axis 88 to provide surfaces 97 and 98 in one of such planes and surfaces 99 and 100 through the other of such planes. In the illustrated construction, the angle between such planes and the arcuate length of each of the internal bearing surfaces is 70 degrees while the arcuate length of the external bearing surfaces is 110 degree. When a leg is rotated to a position in registry with an adjacent leg the surface 97 of each leg engages the surface 98 of the other leg. When then rotated in the opposite direction, the surfaces 99 of the two legs engage at the same time as the surfaces 100 of the two legs engage. Stop surfaces are thereby provided to limit relative pivotal movement of the two legs to a certain angle which is 40 degrees in the illustrated embodiments.

When two subassemblies are assembled, relative pivotal movement of legs of the subassemblies is also limited by the hook portion 60 that is provided on each end structure 54 and that includes the surface 61 engageable with the upper edge of a panel to limit pivotal movement of subassemblies.

A hole 102 is formed about the axis 88 and extends through the portion 94 for optional use of a bolt that might provide addition support for pivotal relative movement of legs and prevent relative axial displacement of legs when assembled. Access for use of such a bolt is facilitated by a recess 103 formed in an opposite wall of the leg. However, a bolt is not required and avoiding its use reduces direct material and manufacturing labor costs and avoids problems with bolts coming loose in the field and with rust of bolts.

Axial displacement of legs when assembled is prevented by engagement between legs and rearwardly extending portions of panels as hereinafter described. Also, the knuckle develops considerable frictional forces helping to hold legs together. The internal and external bearing surfaces may preferably have slight tapers to facilitate molding, but with dimensions such as to obtain a tight frictional engagement when legs are assembled and when the flat surfaces at the ends of the portions 89 and 90 in flat face-to-face engagement with the surface 87. The arrangement avoids "camming out", i.e. induced forces causing legs to be forced apart laterally.

When used as vertical members or posts in an A-frame structure, the frangible portions 71, 72 and 73 can be are hammered out to provide openings for the beams of various types. One type of beam is a special I-beam type of beam such as beams 39, 40 and 46 shown in FIG. 6 which have top and bottom flange portions connected by a narrow web portion. The width of the flange of such a beam may be about 1.5 inches and the depth may be about 10 inches. Another type of beam is a 2 by 8 member of lumber or an equivalent beam of plastic having actual dimensions of about 1.5 inches by 7.5 inches. A third type of beam is a beam of adjustable length such as disclosed in the Giannelli U.S. Pat. No. 5,762,444 having end portions with dimensions corresponding to the actual 1.5 by 7.5 dimensions of a 2 by 8 member of lumber.

Figure 17:
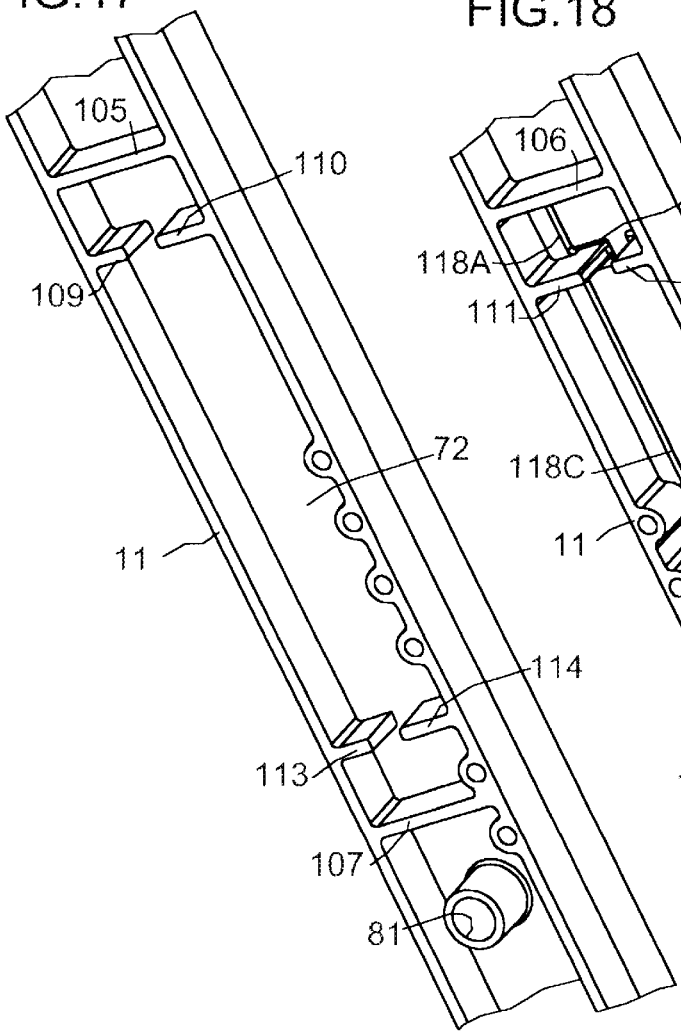
FIGS. 17 and 18 are enlargements of middle portions of FIGS. 11 and 12.
Figure 18:
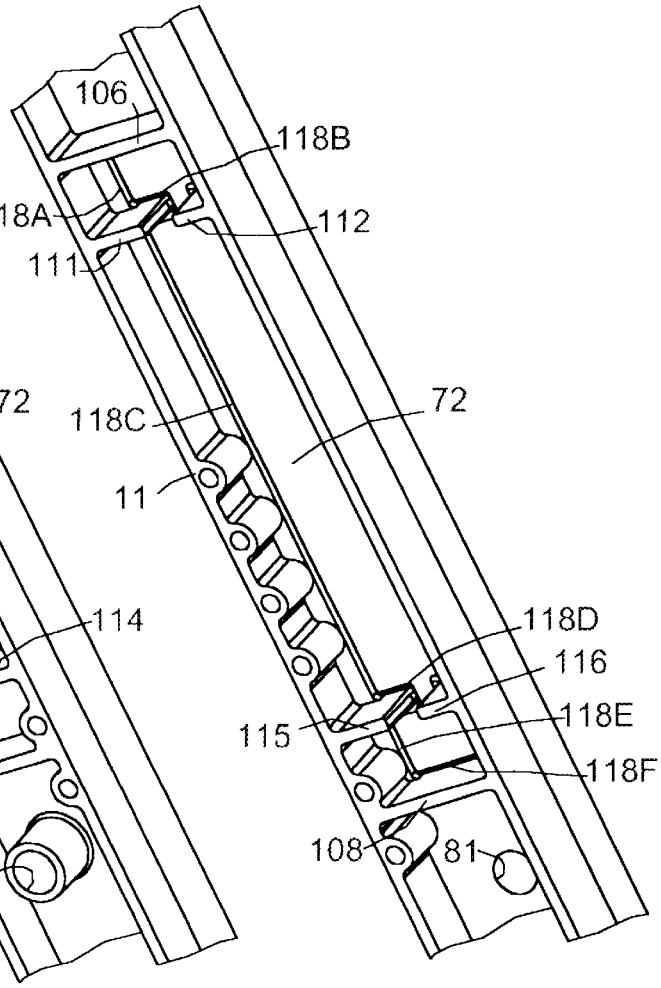

The construction of the legs for accommodating such beams is illustrated in FIGS. 17 and 18 which are enlargements of the portions of FIGS. 11 and 12 that include the frangible portion 72 of the web of the longer leg 11. The portions that include frangible portions 71 and 73 are of similar construction. When the orientation of the leg is reversed from that shown in FIGS. 11, 12, 17 and 18, for use of the leg as a vertical post in a A-frame structure, walls 105 and 106 shown in FIGS. 17 and 18 are located below the lower edge of a beam such as beam 40 having a depth of 10 inches while walls 107 and 108 then engage the upper edge of the beam to be supported therefrom. The walls 105 and 107 extend between flange portions of the beam on one side of the web as shown in FIG. 17 while walls 106 and 108 extend between flange portions of the web on the opposite side of the web as shown in FIG. 18.

Additional wall portions are provided that also allow use with a beam having 1.5 by 7.5 inch dimensions. To underlie the lower side of such a beam, walls 109 and 110 (FIG. 17) are provided on one side of the web and walls 111 and 112 (FIG. 18) are provided on the opposite side of the web. To engage the upper side of such a beam, walls 113 and 114 (FIG. 17) are provided on one side of the web and walls 115 and 116 (FIG. 18) are provided on the opposite side of the web.

To facilitate removal of the frangible portion 72, a groove 118 is formed in the web during molding to define the periphery of the frangible portion and facilitate its removal. The groove 118 is formed in the side of the web shown in FIG. 18 and includes a portion 118A that extends between walls 106 and 111, a portion 118B that extends around the wall 111, a portion 118C that extends from the wall 111 to the wall 115, a portion 118D that extends around the wall 115, a portion 118E that extends from the wall 115 to the wall 108 and a portion 118F that extends along the wall 108. The groove 118 also includes similar portions, not shown in FIG. 18 which extend along the wall 106, between wall 106 and wall 112, around wall 112, between walls 112 and 114, around wall 114 and between walls 114 and 108. The groove 118 facilitates hammering out of the frangible portion to create the desired opening. However, the distance between the bottom of the groove and the opposite face of the web is sufficient to obtain a high strength when the frangible portion is left in place for use of a leg for uses other than as a vertical member or post of an A-frame structure.

Figure 15:
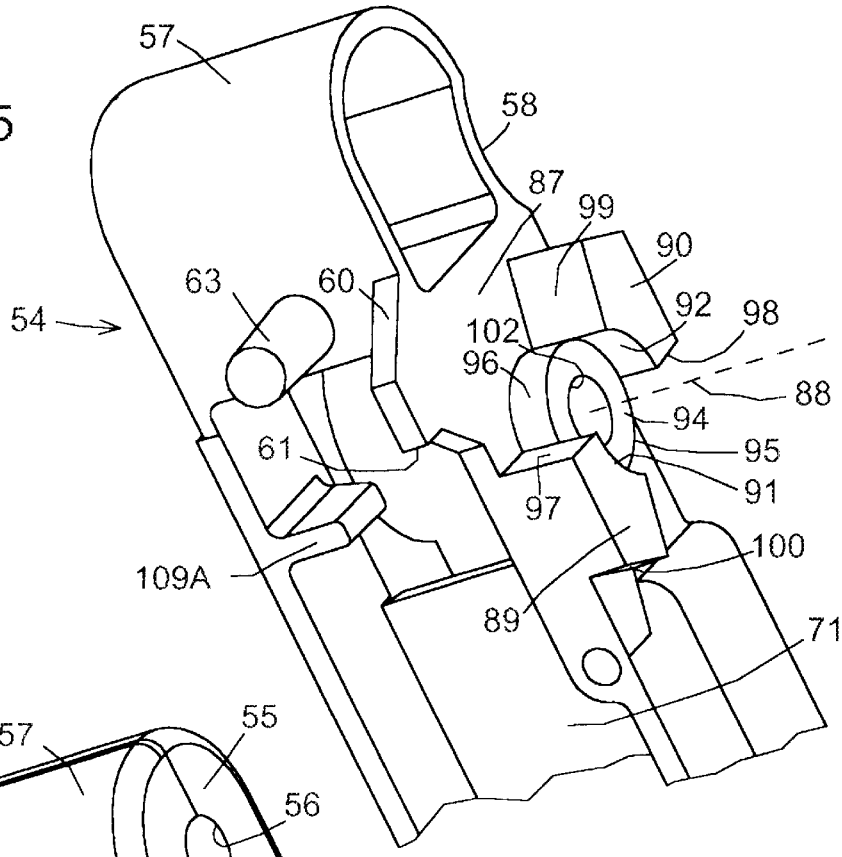
FIGS. 15 and 16 are enlargements of upper portions of FIGS. 11 and 12, showing an end structure that is the same in all legs, both longer and shorter.
Figure 16:
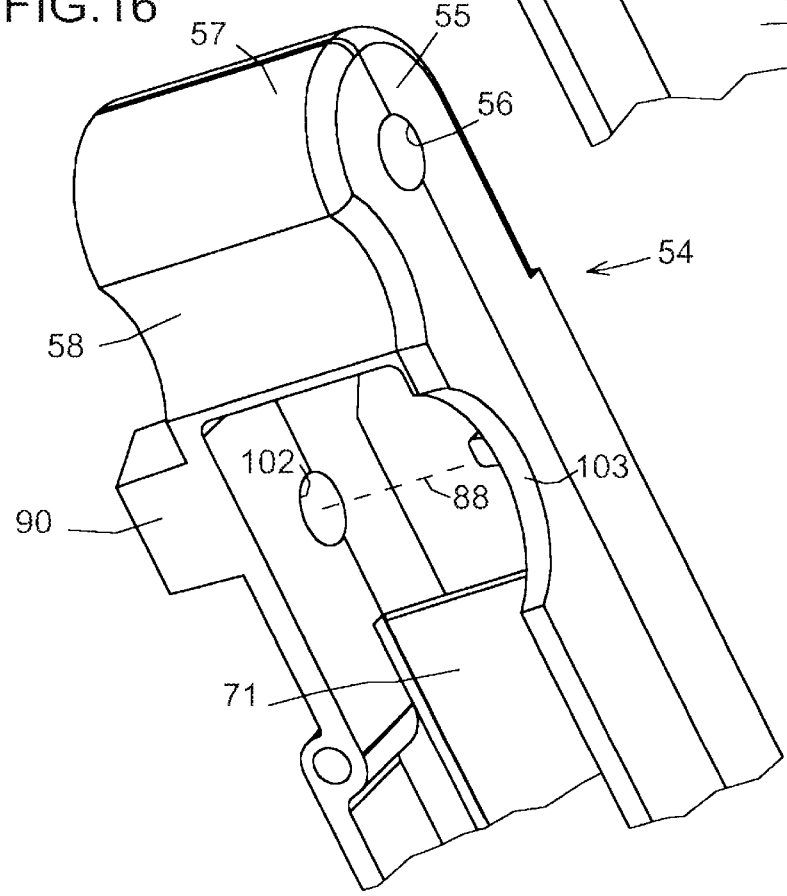

The frangible portions 71 and 73 and the adjacent portions of the leg are like those shown in FIGS. 17 and 18, except that as is shown in FIGS. 15 and 16, the frangible portion 71 and the groove corresponding to groove 118 stop short of the end structure 54, there are no walls corresponding to walls 110, 111 and 112, a wall of the structure 54 serves the same function as walls 105 and 106 in underlying the lower edge of an I-beam type of beam while a wall 109A (FIG. 15) serves the same function as walls 109 and 111 in underlying the lower edge of other types of beams.

Figure 19:
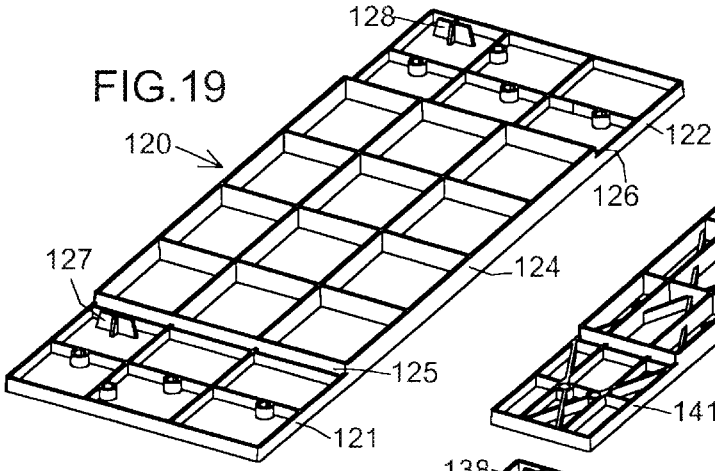
FIG. 19 is a rear perspective view of a panel of intermediate height.

FIG. 19 is rear perspective view of a panel 120 of intermediate height, e.g. eight inches, which may be used as the panel 25 or 26 of FIGS. 2, 4 and 7. Panel 120 includes two end sections 121 and 122 and a central section 124 each formed with reinforcing ribs in a grid pattern. The end sections 121 and 122 are formed with holes for connection of the panel to legs in various configurations and may for example be connected to legs 31 and 32 in FIG. 7 to form the intermediate panel 25. However, the panel is designed to be capable of operation as a top panel and to then perform an important function in limiting relative axial movement of interconnected subassemblies. The end sections 121 and 122 have the same thickness while the central section 124 has a greater thickness to provide additional strength and to also provide outwardly and rearwardly facing surfaces or steps 125 and 126. When the panel 120 is the uppermost panel of a subassembly, at least a portion of he step 125 will be opposite a leg of the opposite subassembly to limit relative axial movement of the subassemblies. In the unfolded operative condition, only a top portion of the step 125 will be opposite a leg of the opposite subassembly and, in the folded condition, the entire length of the step 125 will be opposite a leg of the opposite subassembly.

The panel 120 and a subassembly of which it is a part are necessarily asymmetrical in order for the panel to extend for the full width presented by pairs of legs that are interconnected in the manner as shown. To facilitate proper assembly of subassemblies, two rearward projections 127 and 128 are provided. Projection 127 is spaced outwardly from the step 125 through a distance slightly greater than the thickness of the flange of a leg, to receive the flange of one leg of an opposite subassembly. Projection 128 is spaced from the outer edge of the section 122 through a distance slightly greater than the thickness of the flange of a leg to engage the inside of the outer flange of the other leg of a subassembly.

Figure 20:
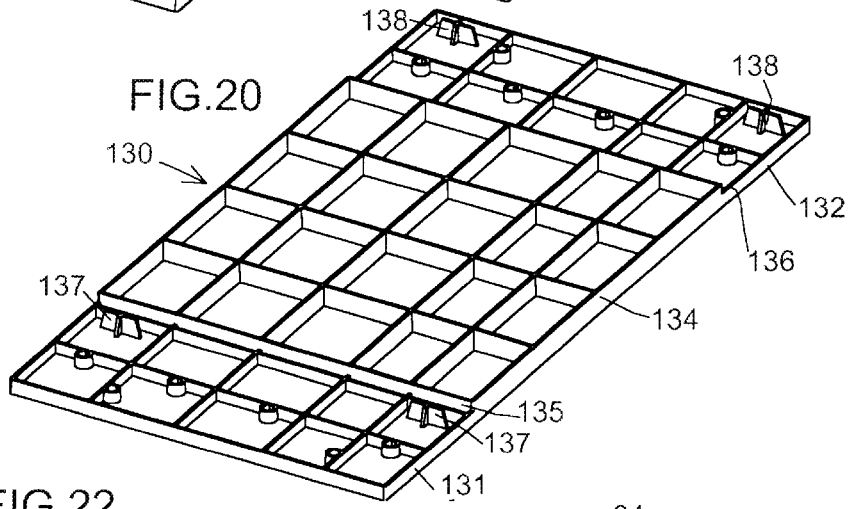
FIG. 20 is a rear perspective view of a tall panel.

FIG. 20 is rear view of a panel 130 of larger height, e.g. twelve inches, which may be used as one of the panels 15 or 19 of the structures shown in FIGS. 1–5 and 7. The panel 130 is similar to the panel 120 of FIG. 19 and includes two end sections 131 and 132 and a central section 134 with steps 135 and 136 corresponding to the sections 121, 121, 124 and steps 125 and 125 of panel 120. Panel 130 differs from panel 120 in being of greater height and in having a pair of projections 137 that serve the same function as projection 127 and in having a pair of projections 138 that serve the same function as projection 138.

Figure 21:
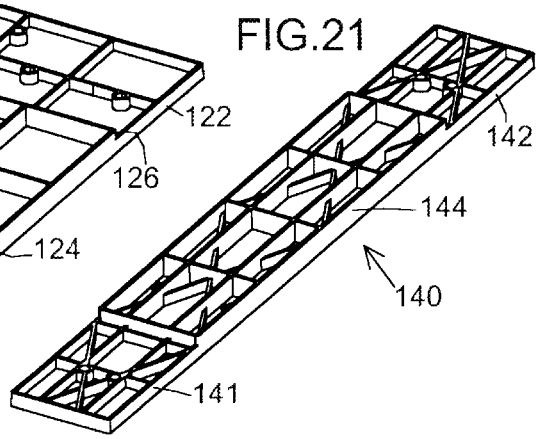
FIG. 21 is a rear perspective view of a short panel.

FIG. 21 is a rear view of a panel 140 of short height, e.g. three inches, which may be used as one of the panels 17, 18, 21 or 22, for example. Panel 140 has end sections 141 and 142 and a central section 144 which are similar to sections 121, 122 and 124 of panel 120 or sections 131, 132 and 134 of panel 130, but differs in having no rearward projections for alignment and also in having a different pattern of reinforcing ribs that includes diagonally extending portions.

Figure 22:
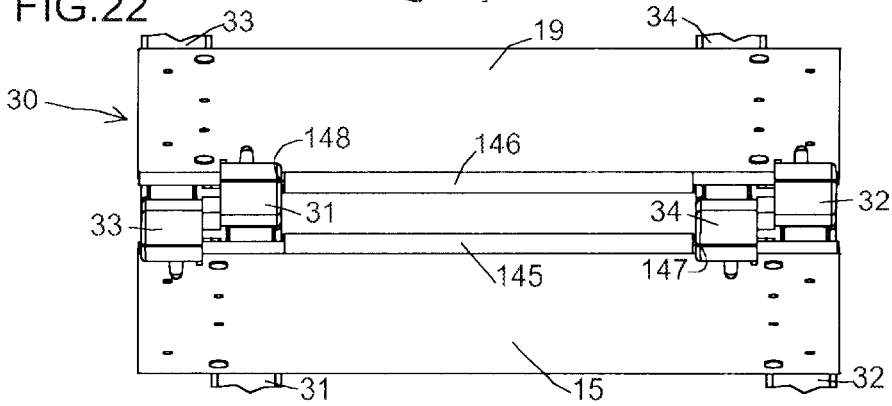
FIG. 22 is a top plan view of a portion of the saw-horse structure of FIGS. 4 and 7 in its operative condition.

FIG. 22 is a top plan view of a portion of the structure 30 that includes the top panels 15 and 19. The top panel 15 is secured to the legs 31 and 32 in forming a first subassembly while the panel 19 is secured to the legs 33 and 34 in forming a second subassembly of the structure. Central portions of the panels 15 and 19, each of which corresponds to the central portion 134 of the panel 130 of FIG. 20, are indicated by reference numerals 145 and 146 and define steps including steps indicated by reference numerals 147 and 148 in FIG. 22. The upper portion of step 147 of first subassembly is opposite the leg 34 of the second subassembly and, at the same time, the upper portion of step 148 of the second assembly is opposite the leg 31 of the first subassembly, thereby preventing relative movement of the subassemblies in one direction. Relative movement in the opposite direction is prevented by engagement of the knuckle portions of the legs.

To assemble the structure 30, the panels may be secured to the legs after assembly of the legs. Preferably, however, each subassembly may be completely assembled and then the two subassemblies are assembled to form the complete structure. In doing so, portions of the central sections 145 and 146 of the panels 15 and 19 that are adjacent the steps 147 and 148 are engaged with outer surfaces of the legs 34 and 31 while flexing the panels 15 and 19 to an extent sufficient to allow the knuckle portions of the legs 31 and 32 to be moved into operative engagement with the knuckle portions of legs 33 and 34. When the knuckle portions are fully engaged, the flexure of the panels is released to move the steps 147 and 148 inwardly to the operative positions shown in FIG. 22. This operation can be effected without tools and without heavy exertion on the part of a factory worker or user.

Disassembly can be effected with a reverse operation in which portions of the panels are flexed outwardly while simultaneously moving the subassemblies apart. Such a reverse operation requires relatively little effort. However, there is very little likelihood that such a reverse operation will take place accidentally, even under the normally rough handling expected at a construction site. If separation should occur, the two assemblies can be readily secured together with little effort.

It will be understood that modifications and variations may be effected without departing from the spirit and scope of the novel concepts of the invention.

What is claimed is:

1. Legs for use in forming barricade structures that include saw-horse type structures in which two pairs of legs are connected by panels to provide two pivotally connected subassemblies and that also include A-frame type structures in which a pair of A-frames are provided each having two vertically spaced openings through which two beams extend to be supported by said A-frames, said legs being configured for use in providing two pairs of legs of a saw-horse type structure, and said legs being also configured for use in positions adjacent A-frames of an A-frame type structure to extend vertically with each leg providing three beam openings along its length, the lower two of said openings being configured for use in registry with two openings of A-frames to receive and be supported by two beams of an A-frame type structure while the third of said openings is configured for use in receiving and providing support for a third beam at a higher elevation, said legs being of molded plastic each including two spaced longitudinally extending flange portions and a web portion extending between and connecting said flange portions, said beam openings being provided in said web portion, one of said flange portions of each leg being formed with a series of holes for mounting of an end portion of a panel in engagement with said one of said flange portions when said legs are used in a saw-horse type structure.

2. Legs as defined in claim 1 and of identical configuration for use in providing four identical legs of a saw-horse type structure.

3. Legs as defined in claim 1 having end portions that are uppermost when said legs are positioned adjacent A-frames to extend vertically, said end portions having terminal ends configured for engagement with a supporting surface when said legs are used in a saw-horse type structure, said legs being so configured as to be formable by injection molding of plastic and also being so configured that legs of similar configurations but shorter lengths can be molded with shortened forms of said end portions.

4. Legs as defined in claim 1, said legs being also usable for stabilizing A-frame type structures by being so configured that in use they can be secured in horizontal positions to the lower ends of legs of A-frames and extend outwardly along a supporting surface beyond lower ends of legs of A-frames.

5. Legs as defined in claim 4, said legs having bolt holes positioned to register with bolt holes near the ends of A-frame legs of A-frame type structures to be stabilized.

6. Legs as defined in claim 1, including projecting portions at one end of one of said flange portions of each leg configured for engaging projecting portions of an identical leg in side-by-side relation when said legs are used in providing legs of a saw-horse type structure, said projecting portions being configured for providing a knuckle journaling said legs for relative movement about a pivot axis when said legs are used in providing legs of a saw-horse type structure.

7. Legs as defined in claim 6, said one end of said one of said flange portions being lowermost when said leg is used in an A-frame type structure, and each leg including a portion extending from an opposite end of said one of said flange portions and to the other flange portion and formed with a bolt hole for mounting of a warning light above a third beam that is supported at a higher elevation when said leg is used in an A-frame type structure.

8. Legs as defined in claim 7, each including portions extending beyond said projecting portions at said one end of said one of said flange portions and providing a bolt hole for mounting of a warning light when said legs are used in a saw-horse type structure.

9. Legs for use in forming barricade structures that include saw-horse type structures in which two pivotally connected subassemblies are provided each subassembly including a pair of legs connected by at least one panel, said legs being usable in two pairs with the legs of each pair having configurations that are identical to each other and to each of the legs of the other pair and each pair being configured for use in providing a subassembly of a saw-horse type structure, each of said legs of each pair including projecting portions configured for use in engaging identical projecting portions of an identical leg of the other pair and providing a knuckle journaling the two legs for relative movement about a pivot axis between a closed condition in side-by-side relation and an open condition in inverted-V relation.

10. Legs as defined in claim 9, wherein said projecting portions of each leg define a pair of internal bearing surfaces facing each other and said pivot axis and a pair of external bearing surfaces facing in opposite directions away from said pivot axis, said pair of internal bearing surfaces of each leg of each pair of legs being engageable with said external bearing surfaces of a leg of the other pair to journal the two legs for said relative pivotal movement.

11. Legs as defined in claim 10, wherein said projecting portions of each leg define stop surfaces in parallel relation to said pivot axis, said stop surfaces of each leg of each pair of legs being engageable with said stop surfaces of a leg of the other pair to limit said relative pivotal movement.

12. Legs as defined in claim 10, wherein said projecting portions of each leg project from a surface in a first plane transverse to said axis, wherein said external bearing surfaces of each leg extend axially between said first plane and a second plane in spaced parallel relation to said first plane and extend arcuately for more than ninety degrees between third and fourth planes that extend through said axis, and wherein each of said internal bearing surfaces extends axially between said second plane and a fifth plane in outwardly spaced parallel relation to said second plane.

13. Legs as defined in claim 12, wherein said projecting portions of each leg define stop surfaces in said third and fourth planes, said stop surfaces of each leg being engageable with said stop surfaces of the other leg to limit said relative pivotal movement.

* * * * *